US005923212A

United States Patent [19]

Womack

[11] Patent Number: 5,923,212

[45] Date of Patent: Jul. 13, 1999

[54] BIAS GENERATOR FOR A LOW CURRENT DIVIDER

[75] Inventor: Richard H. Womack, Albuquerque, N.M.

[73] Assignee: Philips Electronics North America Corporation, New York, N.Y.

[21] Appl. No.: 08/854,712

[22] Filed: May 12, 1997

[51] Int. Cl.[6] ..... G05F 1/44

[52] U.S. Cl. ..... 327/541; 327/543

[58] Field of Search ..... 327/538, 540, 327/541, 543

[56] References Cited

U.S. PATENT DOCUMENTS

| | | | |
|---|---|---|---|
| 4,507,573 | 3/1985 | Nagano | 327/542 |
| 4,694,199 | 9/1987 | Goetz | 327/543 |
| 5,233,289 | 8/1993 | Beasom | 323/313 |
| 5,493,207 | 2/1996 | Beasom | 323/313 |
| 5,608,344 | 3/1997 | Marlow | 327/206 |
| 5,610,550 | 3/1997 | Furutani | 327/543 |

FOREIGN PATENT DOCUMENTS

| | | | |
|---|---|---|---|
| 2-35686 | 2/1990 | Japan | 327/543 |

*Primary Examiner*—Timothy P. Callahan
*Assistant Examiner*—Maria Hasanzadah
*Attorney, Agent, or Firm*—Brian J. Wieghaus

[57] ABSTRACT

A voltage divider is protected from current paths created by parasitic devices. The voltage divider includes a first string of diode-connected MOS transistors and a second string of diode-connected MOS transistors. A substrate bias terminal of each transistor in the first string is coupled to a substrate bias terminal of a corresponding transistor in the second string. The first string of transistors provides an output voltage which is protected from current paths created by parasitic devices.

8 Claims, 2 Drawing Sheets

BIAS GENERATOR FOR A LOW CURRENT DIVIDER

BACKGROUND OF THE INVENTION

1. Field of the Invention

The present invention relates generally to a voltage divider. More particularly, the present invention relates to a voltage divider which is less susceptible to having the voltage divider output affected by alternate current paths provided by parasitic transistors and capacitors.

2. Description of the Background Art

Voltage dividers are widely used on most integrated circuits. Voltage dividers provide additional voltages needed in the operation of an integrated circuit, avoid the need for additional voltage supply pins on the integrated circuit packaging, and avoid the need to route additional voltage supply lines through out the integrated circuit. However, voltage dividers can fail to provide the anticipated voltages on integrated circuits because of parameter variations in the circuit devices and unintended parasitic structures that are an inevitable result of the integrated circuit fabrication process.

Referring now to FIG. 1, a circuit diagram of a prior art voltage divider is shown, implemented in a MOSFET technology. FIG. 1 illustrates a standard voltage divider circuit to produce an output voltage equal to one third of the input voltage. Transistor P1 has its source 100 connected to its substrate 101 and its gate 102 connected to its drain 103. Transistor P2 has its source 104 connected to its substrate 105 and its gate 106 connected to its drain 107. Transistor P3 has its source 108 connected to its substrate 109 and its gate 110 connected to its drain 111. Input voltage V1 is connected to the source terminal 100 and substrate bias 101 for P1, the source terminal 104 of P2 is connected to the drain terminal 103 of P1, the source terminal 108 of P3 is connected to the drain terminal 107 of P2, and V2 is the voltage divider output from the source terminal 108 for P3 whose drain terminal 111 is connected to ground.

Two fundamental assumptions used in the design of such voltage dividers are that the same amount of current is flowing through all the transistors in the voltage divider, and that the transistors each have the same threshold voltage and device transconductance (i.e., the same MOSFET channel width-to-length ratio). In this case, each transistor will have the same voltage drop between drain and source. If a transistor has a smaller device transconductance, it will have a larger voltage drop between drain and source than the other transistors. If a transistor has a larger device transconductance, it will have a smaller voltage drop between drain and source than the other transistors. But device transconductance varies according to the geometry of the transistor dimensions and can be controlled much more tightly than the threshold voltage.

The threshold voltage of each transistor depends on several factors, including the substrate bias of the transistor. If a set of MOS devices, having different biases on their sources, had their substrates connected to a power supply, then their threshold voltages would be different and the voltage divider's output (i.e. V2) would not be at its predicted value. To avoid this problem, the substrates 101, 105, and 109 are respectively connected to sources 100, 104, and 108. Under certain bias conditions, such as when V1 is less than an integer multiple of the thresholds of the MOS devices P1, P2 and P3, the current through the MOS devices decreases significantly. When this occurs, the substrate biases at nodes 104 and 108 become sensitive to currents in the parasitic devices inherent to the CMOS process. Thus, the currents in the parasitic devices have a significant effect on the currents in the MOS devices. In specific, lateral NPNs which have their collectors connected to the wells of the MOS transistors may conduct current to the point of keeping the voltage V2 less than an integer divider of the voltage at V1, regardless of what the V1 voltage might otherwise have been.

What is needed is a voltage divider circuit in which the output is less susceptible to parasitic effects that can change the desired output voltage.

SUMMARY OF THE INVENTION

The present invention is a voltage divider circuit that uses two voltage divider strings, each string being comprised of a serially-connected chain of diode-connected MOS transistors in a voltage divider configuration. The two voltage divider strings are connected in parallel with regards to the input voltage and the ground potential. One voltage divider string produces the actual voltage divider output as a fraction of the input voltage while the second voltage divider string has the same number of diode-connected MOS transistors as the first voltage divider string. Each voltage divider transistor in the second voltage divider string has its source terminal connected to its substrate bias and additionally provides the substrate bias for the corresponding voltage divider transistor in the first voltage divider string. Thus, when the first voltage divider string produces a very low current and the transistors are operating in the subthreshold region (where the absolute value of the gate voltage is slightly less than the absolute value of the transistor threshold voltage), the value of the output voltage from the first voltage divider string will not be greatly affected by parasitic devices such as parasitic bipolar transistors and parasitic diodes that can provide an alternative current path to the transistors in the first voltage divider string.

DETAILED DESCRIPTION

The present invention uses a critical voltage divider circuit, which produces the output voltage, and a second voltage divider circuit to mimic the critical voltage divider circuit. The purpose of the second voltage divider circuit is to provide the bias for the wells or substrate of the transistors in the critical voltage divider circuit.

Figure 1:
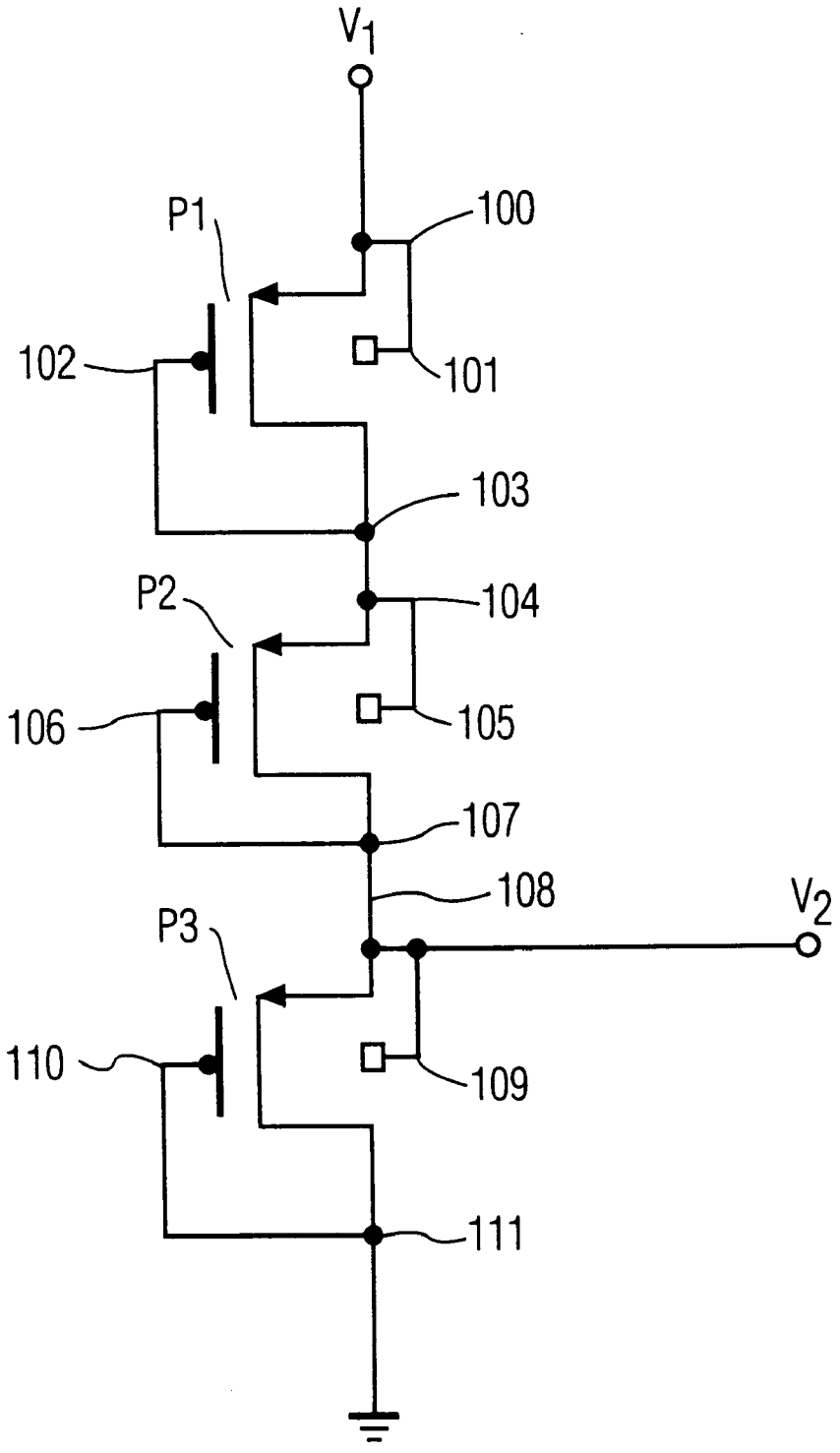
FIG. 1 is a circuit diagram of a prior art voltage divider.
Figure 2:
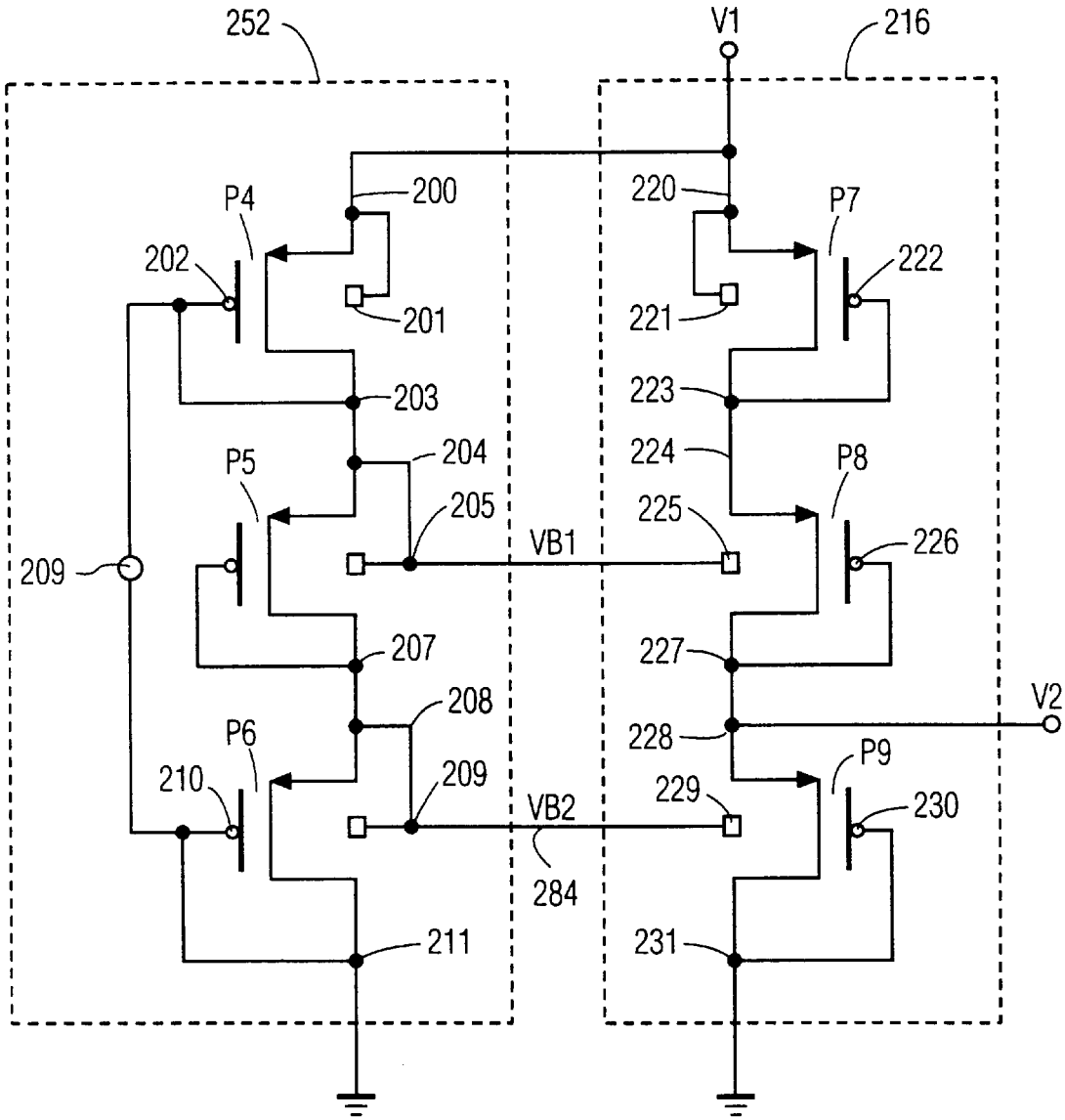
FIG. 2 is a circuit diagram of an exemplary embodiment of the new voltage divider circuit.

Referring now to FIG. 2, a circuit diagram of an exemplary embodiment of the present invention is shown. FIG. 2 shows a voltage divider circuit that uses two voltage divider strings. The two voltage divider strings are connected in parallel with regards to the input voltage and the ground potential. Each voltage divider string is comprised of three diode-connected (drain terminal connected to the gate terminal) P-channel transistors. The critical (also referred to as the "first") voltage divider string 216 produces the actual voltage divider output at the source terminal of transistor P9 as a fraction of the input voltage V1. Voltage divider 216 is comprised of three transistors P7, P8 and P9. Transistor P7 has its source 220 connected to its substrate 221 and its gate 222 connected to its drain 223. Transistor P8 has its gate 226 connected to its drain 227. Transistor P9 has its gate 230 connected to its drain 231. Input voltage V1 is connected to source terminal 220 and substrate bias 221 for P7, source terminal 224 of P8 is connected to drain terminal 223 of P7, source terminal 228 of P9 is connected to drain terminal 227 of P8, and V2 is the output voltage produced by source terminal 228 for P9, whose drain terminal 231 is connected to ground. Voltage divider 216 has each of substrate bias terminals 221, 225, and 229 connected to the substrate bias terminal of a corresponding transistor in second voltage divider string 252.

Second voltage divider string 252 is comprised of three transistors P4, P5 and P6. Transistor P4 has its source 200 connected to its substrate 201 and its gate 202 connected to its drain 203. Transistor P5 has its source 204 connected to its substrate 205 and its gate 206 connected to its drain 207. Transistor P6 has its source 208 connected to its substrate 209 and its gate 210 connected to its drain 211. Input voltage V1 is connected to source terminal 200 and to substrate bias 201 for P4, source terminal 204 of P5 is connected to drain terminal 203 of P4, source terminal 208 of P6 is connected to drain terminal 207 of P5, and bias voltage VB2 appears at source terminal 208 for P6, whose drain terminal 211 is connected to ground.

Bias voltage VB1 is supplied to P5 and P8 via line 282. Line 282 connects substrate 225 to substrate 205, which is coupled to source terminal 204. Bias voltage VB2 is supplied to P6 and P9 via line 284. Line 284 connects substrate 229 to substrate 209, which is coupled to source terminal 208. Bias voltages VB1 and VB2 are supplied to the wells of P8 and P9 respectively. If current to the substrate is supplied by either VB1 or VB2 it will be supplied by the second voltage divider string 252, and the currents in transistors P7, P8, and P9 of voltage divider string 216 will be the same. An optional current source 290 is connected to gate 202 and drain 203 of P4 and to gate 210 and drain 211 of P6 in voltage divider string 252. Current source 290, through drain 203 of P4 and bias voltages VB1 and VB2, supplies the necessary reverse bias current into the N-wells or N-type substrates of P9 and P8 in voltage divider string 216 to prevent the PN source diffusion junctions of P9 and P8 from forward biasing and activating bipolar transistor action in the parasitic bipolar structures inherently present in the FETs. An example of a parasitic bipolar transistor structure in a P-channel FET is the heavily doped P diffusions comprising the source and drain of the FET acting as the emitter and collector diffusions of a PNP bipolar transistor, respectively, and the moderately doped N substrate between the source and drain of the FET acting as the base of the PNP bipolar transistor, with the N-type substrate or N-well diffusion acting as the base terminal. Another example of a parasitic bipolar transistor structure in a CMOS P-well or P substrate with an N channel FET is the heavily doped N diffusions comprising the source and drain of the FET acting as the emitter and collector diffusions of an NPN bipolar transistor, respectively, and the moderately doped P-well or substrate of the FET acting as the base of the NPN bipolar transistor, with the P-type substrate or P-well diffusion acting as the base terminal. In addition to a parasitic bipolar transistor inherent in the structure of an individual FET, adjacent FETs may form additional parasitic bipolar transistors where one FET's source diffusion acts as a collector diffusion and another nearby FET's drain diffusion acts as an emitter diffusion, and the common substrate or well acts as the base of the bipolar transistor.

Thus, when voltage divider string 216 produces a very low current and transistors P7, P8, and P9 are operating in the subthreshold region, the value of the output voltage from voltage divider string 216 will not be greatly affected by parasitic devices, such as parasitic bipolar transistors and parasitic diodes that can provide an alternative current path to the transistors in voltage divider string 216.

The present invention can be implemented with equal gate width-to-length ratio P-channel MOS transistors in the serially-connected chain in the critical voltage divider to obtain an integer ratio of the output voltage to the input voltage. Or the present invention can be implemented with unequal gate width-to-length ratio P-channel MOS transistors in the serially-connected chain in the critical voltage divider to obtain any other desired ratio of the output voltage to the input voltage. The present invention can also be optimized in area and power consumption by using gate width-to-length ratio P-channel MOS transistors in the serially-connected chain in the critical voltage divider that are not equal to the gate width-to-length ratio P-channel MOS transistors in the serially-connected chain in the second voltage divider.

Those skilled in the art will recognize that the voltage divider MOS transistors P4–P9 could be either N-channel or P-channel MOS transistors, depending on the type of substrate and wells selected. Those skilled in the art will also recognize that the voltage dividers in this invention can be implemented with a greater or lesser number of MOS transistors in each serially-connected chain, depending on the application. Therefore, the present invention is limited only by the following claims.

What is claimed is:

1. A voltage divider circuit, comprising:

a first plurality of serially coupled transistors each having a gate, a source and a drain coupled to the gate of the respective transistor, said first plurality including a first transistor having its source coupled to receive an input voltage and a second transistor with its drain coupled for providing an output voltage; and a second plurality of serially coupled transistors each having a gate, a source, and a drain coupled to the gate of the respective transistor, said second plurality of serially coupled transistors being coupled to receive the input voltage and including predetermined ones having substrate terminals respectively coupled to source terminals of said predetermined ones of said second plurality of transistors and respectively coupled to substrate terminals of predetermined ones of said first plurality of transistors, for providing a substrate bias voltage to each of said predetermined ones of said first plurality of transistors.

2. The voltage divider of claim 1, wherein said second plurality of serially coupled transistors includes a first transistor and a second transistor, said first transistor having a source coupled to receive said input voltage and a gate, and said second transistor having a drain coupled to ground and coupled to said gate of said second transistor.

3. The voltage divider of claim 2, further comprising a current source coupled between said gate of said first transistor and said drain of said second transistor of said second plurality of transistors.

4. A voltage divider, comprising:

a divider string of serially-coupled, diode-connected transistors, each having a substrate, a drain, a source, and a gate coupled to the respective drain, said divider string receiving an input voltage and providing as an output a predetermined portion of said input voltage;

means for providing a substrate bias voltage to the substrate of at least one of said transistors of said divider string for maintaining at least a substantially equal current through each of the transistors of the divider string.

5. The voltage divider of claim 4, wherein said voltage divider further comprises means for preventing said source terminals from forward biasing.

6. The voltage divider of claim 4, wherein voltage divider further comprises means for supplying current to said divider means to prevent said source terminals from forward biasing.

7. A voltage divider circuit operating between a first voltage supply and a second, lower voltage supply, comprising:

a first transistor having a gate, a source terminal for receiving the first voltage supply, a drain terminal coupled to said gate, and a substrate terminal coupled to said source terminal;

a second transistor having a gate, a substrate terminal, a source terminal coupled to said drain terminal of said first transistor, and a drain terminal coupled to said gate and for providing an output voltage;

a third transistor having a gate, a substrate terminal, a source terminal coupled to said drain terminal of said second transistor, and a drain terminal coupled to said gate and coupled to the second voltage supply;

a fourth transistor having a gate, a source terminal for receiving the first voltage supply, a drain terminal coupled to said gate, and a substrate terminal coupled to said source terminal;

a fifth transistor having a gate, a source terminal coupled to said drain terminal of said fourth transistor, a drain terminal coupled to said gate, and a substrate terminal coupled to said source terminal and coupled to said substrate terminal of said second transistor; and a sixth transistor having a gate, a source terminal coupled to said drain terminal of said fifth transistor, a drain terminal coupled to said gate and to the second voltage supply, and a substrate terminal coupled to said source terminal and coupled to said substrate terminal of said third transistor.

8. The circuit of claim 7, further comprising a current source coupled between said drain of said sixth transistor and said gate of said fourth transistor.

* * * * *